United States Patent [19]

Forslund

[11] 4,317,714

[45] Mar. 2, 1982

[54] METHOD AND APPARATUS FOR DIVIDING A MIXTURE OF PIECES OR FRAGMENTS OF DIFFERENT MATERIALS AND HAVING DIFFERENT SIZES INTO TWO OR MORE FRACTIONS

[75] Inventor: Sven E. Forslund, Ingarö, Sweden

[73] Assignee: AZ Sellbergs AB, Stockholm, Sweden

[21] Appl. No.: 131,677

[22] Filed: Mar. 19, 1980

Related U.S. Application Data

[63] Continuation of Ser. No. 872,854, Jan. 27, 1978, abandoned.

[30] Foreign Application Priority Data

Jan. 28, 1977 [SE] Sweden ..... 7700928

[51] Int. Cl.[3] ..... B07B 15/00

[52] U.S. Cl. ..... 209/44; 209/481

[58] Field of Search ..... 209/44, 396, 480, 481, 209/436, 442, 314, 395; 198/775, 776

[56] References Cited

U.S. PATENT DOCUMENTS

| | | | |
|---|---|---|---|
| 546,415 | 9/1895 | Compton | 198/776 |
| 549,699 | 11/1895 | Abele | 209/481 X |
| 1,136,674 | 4/1915 | Houston | 209/396 X |
| 1,864,005 | 6/1932 | Taylor | 198/775 X |
| 2,079,059 | 5/1937 | Winkelman | 209/481 X |
| 2,286,607 | 6/1942 | Dyer | 209/481 X |
| 3,506,122 | 4/1970 | Ranger | 209/395 X |

FOREIGN PATENT DOCUMENTS

| | | | |
|---|---|---|---|
| 85316 | 5/1894 | Fed. Rep. of Germany | 209/480 |
| 290081 | 6/1913 | Fed. Rep. of Germany | 209/481 |
| 692833 | 5/1940 | Fed. Rep. of Germany | 209/44 |
| 21565 | 7/1961 | Fed. Rep. of Germany | 209/314 |
| 756583 | 12/1933 | France | 209/396 |
| 712148 | 7/1954 | United Kingdom | 209/481 |
| 742532 | 5/1956 | United Kingdom | 209/44 |
| 424595 | 8/1972 | U.S.S.R. | 209/44 |
| 447183 | 8/1972 | U.S.S.R. | 209/481 |
| 484018 | 2/1973 | U.S.S.R. | 209/481 |

*Primary Examiner*—Robert Halper
*Attorney, Agent, or Firm*—Fred Philpitt

[57] ABSTRACT

A method of dividing a mixture of pieces or fragments of different materials and different sizes, e.g. fragments of domestic wastes, into two or more fractions, enriched with respect to one or more materials, in which method the mixture is charged to the lower part of an inclined shaking table arranged for rotary movement about two shafts at an amplitude and a speed of rotation so adjusted that large pieces or fragments of material of high elasticity and/or rigidity are caused to bounce on the shaking table and, as a result of the inclination of said table, bounce down to the lower end thereof and away from said lower end to form a first fraction, while pieces or fragments of material which lack, or have only slight rigidity and/or elasticity are moved as a result of the rotary movement of the shaking table, and are discharged from the upper end of said table to form a second fraction.

8 Claims, 5 Drawing Figures

Figure 1:
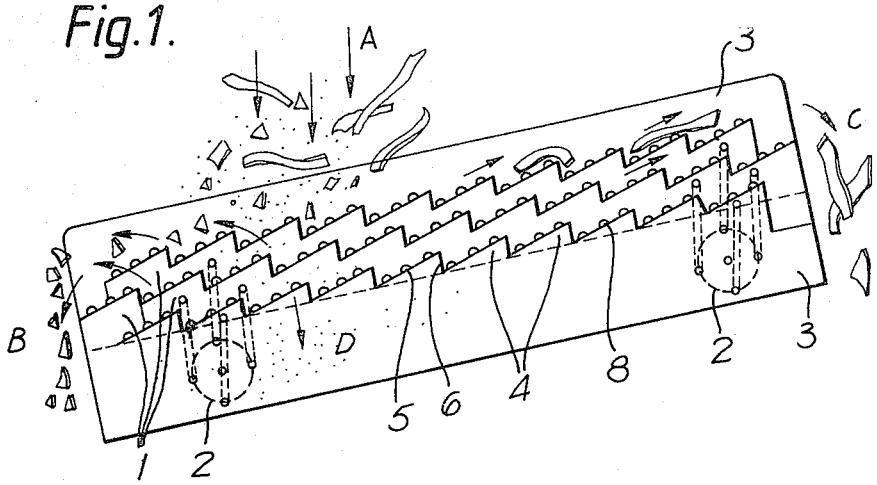

METHOD AND APPARATUS FOR DIVIDING A MIXTURE OF PIECES OR FRAGMENTS OF DIFFERENT MATERIALS AND HAVING DIFFERENT SIZES INTO TWO OR MORE FRACTIONS

This is a continuation of application Ser. No. 872,854, filed Jan. 27, 1978, now abandoned.

The present invention relates to a method and an apparatus for dividing a mixture of pieces or fragments of different materials and sizes into two or more fractions. The prime intention herewith is not solely to divide the pieces or fragments into fractions of given sizes, but to separate the different types of materials one from the other.

One example of mixtures of different sized pieces or fragments of different materials, the dividing of which mixture into fractions enriched in materials of the same or a similar nature has become of increasing interest in latter times, is fragmented waste materials, and in particular fragmented domestic waste materials. A multiplicity of methods of separating the different materials have been proposed, of which methods wind sieving forms an important step. One such method is that described in the U.S. Pat. specification No. 3,524,594. A common feature of all methods based on wind sieving is that the apparatus for carrying out these methods have a relatively low capacity and require much energy.

The Swedish patent specification No. 7404856-2 describes a method in which waste is fragmented into two principle fractions which are subsequently separated to form said two main fractions, by means of a sieve having a given mesh size. The coarse fraction will contain mainly fragments of paper and plastics materials, and also some large metal fragments or large fragments of other materials, which must be separated from the coarse fraction in a subsequent separation step. According to one embodiment, it is proposed that the iron fragments are removed magnetically in a separate step prior to sieving the waste.

The present invention proposes a method which, whilst consuming but a small amount of energy, enables fragmented domestic waste, in accordance with one embodiment of the method, to be divided into a fraction containing mainly large fragments of metal, wood, rubber and rigid plastics, a second fraction containing mainly fragments of paper and plastics materials and being free from metal fragments, and a third fraction containing inorganic and organic particles of small particle size.

The method according to the invention, however, can also be used when separating mixtures of materials other than domestic waste. An example in this connection is the separation of metal fragments from plastics, in which case if so desired only two fractions need be made, or the treatment of topsoil to remove stones and weeds etc. (in their respective fractions) from the topsoil.

The method according to the invention is characterized by the fact that the mixture of pieces or fragments of the materials is passed to the lower part of an inclined shaking table arranged to be rotated or oscillated about two shafts at an amplitude and at a speed so adjusted that large pieces or fragments of material of relatively high elasticity and/or rigidity are caused to bounce on the table and, as a result of the inclination of the table, to bounce to the lower end of the table to form a first fraction, while pieces or fragments of material which are limp or of but slight rigidity and/or elasticity are moved by the shaking table, and also optionally by friction elements mounted thereon, upwardly along the same and discharged from the table at the other end thereof to form a second fraction.

According to a further embodiment of the method according to the invention, a third fraction comprising fragments of small particle size is separated, by providing the shaking table with a large number of openings having a size corresponding to the highest particle size desired in said third fraction. By providing the shaking table with two or more regions of openings of different size, the size of the openings for the various regions increasing in a direction towards the upper and/or lower end of the shaking table, it is possible to remove further fractions.

According to a preferred embodiment of the method according to the invention, the shaking table used is one whose lower part is angled to the main part of the table at a location on said table, the slope of said lower part from said location to the lower end of the table being steeper than the slope of said major part from the location to the upper end of the table.

Conveniently the location at which the lower part is angled to the major part is from 15–45%, preferably from 25–40% of the length of the shaking element measured from its lower end. In this respect, said location may be placed further towards the upper limits of these ranges in the case of shorter shaking tables, while in the case of longer tables said location should be nearer the lower limits of said ranges. Suitably the mixture of pieces or fragments of material is placed on the table at a point above the centre of the lower part of the table.

The invention also relates to an apparatus for carrying out the preferred embodiment of the method according to the invention. This apparatus is characterized by the fact that it comprises at least one inclined shaking element having an upper part and a lower part and being arranged to move about two shafts in a path such that an arbitrarily selected point on the element moves in a circular path, said lower part being angled to said upper part and having an inclination to the horizontal which is greater than the inclination of the upper part thereto.

Figure 2:
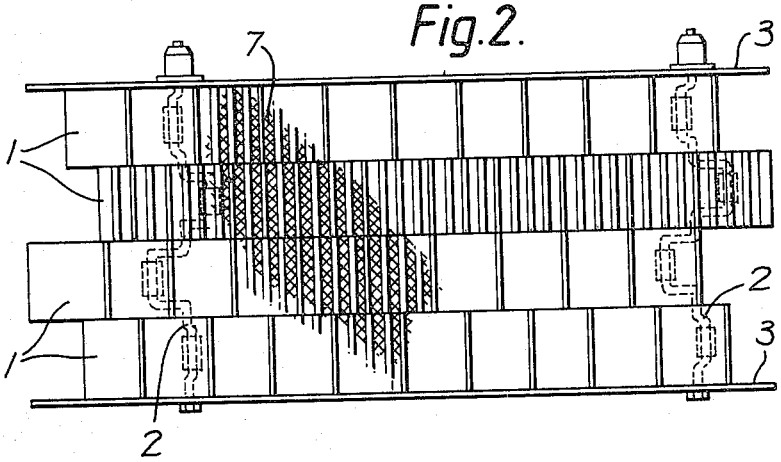
Figure 3:
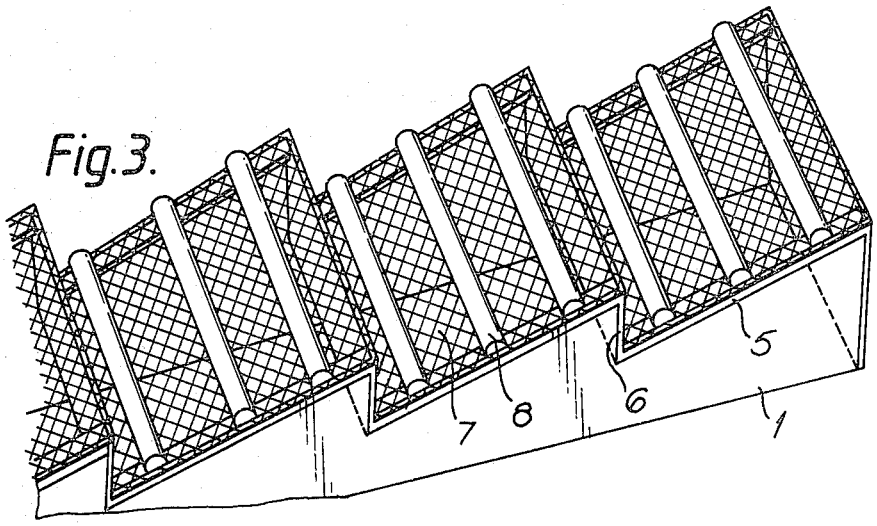
Figure 4:
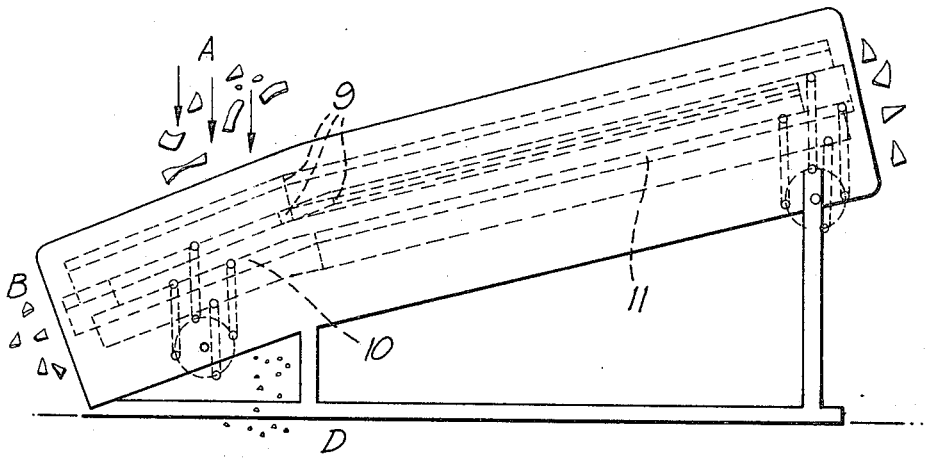
Figure 5:
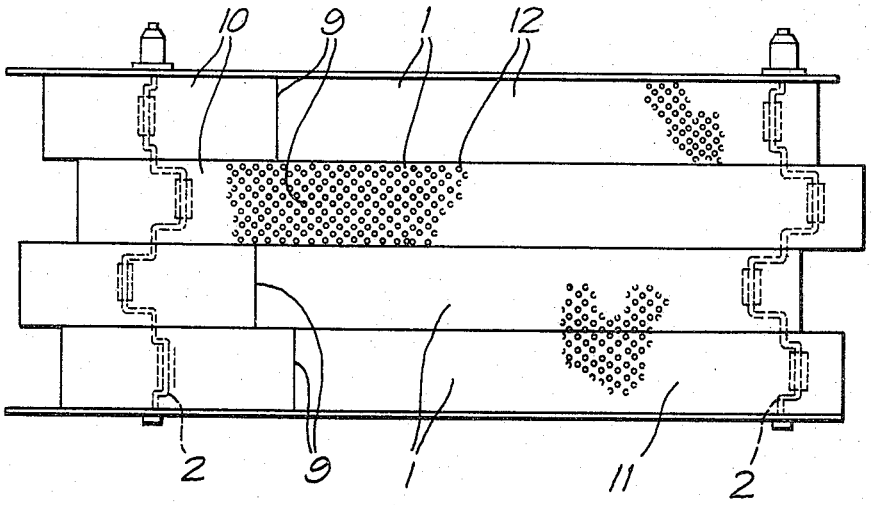

So that the invention will be more readily understood and further features thereof made apparent, exemplary embodiments of the method according to the invention will now be described with reference to the accompanying schematic drawings, in which:

FIG. 1 illustrates in side view an apparatus for carrying out one embodiment of the method according to the invention, the forward side wall of the apparatus having been removed, FIG. 2 is a plan view of the apparatus shown in FIG. 1, FIG. 3 is a perspective view seen obliquely from above of an element of the apparatus shown in FIGS. 1 and 2, FIG. 4 is a side view of an apparatus for carrying out a further embodiment of the method according to the invention, and FIG. 5 is a plan view of the apparatus shown in FIG. 4.

The apparatus illustrated in FIGS. 1–3 comprises four parallel shaking elements 1 journalled about two crank shafts 2 which, in turn, are journalled in side walls 3. The shaking elements 1 are displaced in relation to each other, as illustrated in FIGS. 1 and 2, such that when oscillated or rotated by the shafts 2 they will be mutually out of phase. The shafts 2 are located in separate horizontal planes, such that the apparatus will slope. The upper surface of each element 1 exhibits a plurality of sequentially arranged ridges 4 having a gradually sloping side 5 and a side 6 which slopes abruptly towards an imaginary connection between the shafts 2. The upper side of the ridges carry a metal-wire net 7. A plurality of friction elements in form of transversely extending dogging elements 8 are mounted on the gradually sloping side of the ridges.

As illustrated in FIG. 1, a mixture A of fragments of different materials and sizes is charged to the lower part of the shaking elements 1 whilst the crank shafts 2 rotate clockwise. The elements are thus rotated or oscillated by the crank shafts in a manner such that an arbitrarily selected point on a respective element will move in a circular path. By adjusting the speed at which the crank shafts rotate in a manner such that the vertical movement of the elements exceeds the acceleration at which the mixture freely falls, heavy, rigid and/or elastic fragments, such as pieces of wood, metal, rigid plastics, rubber, will bounce on the gradually sloping sides 5. By adjusting the slope of the sides 5 relative to the horizontal plane, the direction in which said heavy fragments bounce can be adjusted so that said fragments move to the left in the figure, to the extent desired. Thus, as a result of these bouncing movements, these fragments will move towards the lower part (to the left in FIG. 1) of the apparatus and gradually leave said lower part to form a first fraction B.

Larger fragments having no, or only slight rigidity and/or elasticity, such as large fragments of paper and large, thin fragments of plastics in the mixture A will first fall on a side associated with one of the ridges 4. When the side 5 is lowered from its highest position, as a result of the rotary movement of the element, the speed at which the element moves (see above) is such that the fragments are unable to accompany said element and are left suspended in space to subsequently fall on to said element. Whilst the fragments are falling substantially vertically, the element 1 is able to move to such an extent in its movement path that the fragments will fall on parts of the element 1 which, as seen in the Figure, are located more to the right of the element than that location at which they left the element a moment previously, which parts are then moving upwardly. When these fragments meet the element they do not bounce, and the dogging elements 8 prevent the fragments from sliding along the side 5. When the element, a moment later, moves vertically downwards again in its movement path, whereupon the fragments again part company with said element, the fragments have moved a short distance to the right in the figure, the extent of this distance being dependent upon the speed of rotation and the amplitude of the movement of said element. Consequently, this type of fragment will be conveyed in a direction towards the upper part (to the right in the figure) of the apparatus and will gradually leave the apparatus to form a second fraction C.

A third fraction D comprising small fragments is obtained by causing these fragments to pass straight through the meshes in the net 7. When the mixture A comprises fragmented domestic waste, the fraction D may comprise glass, sand, small fragments of paper and plastics material etc.

The apparatus illustrated in FIGS. 4 and 5 comprises four parallel shaking elements 1 mounted for rotation about two shafts 2, which in turn are mounted in side walls, the shaking elements being phase-displaced relative to one another and the apparatus being inclined to the horizontal in a manner corresponding to the apparatus illustrated in FIGS. 1–3. Each element 1 of the apparatus illustrated in FIGS. 4 and 5, however, is angled at a location 9 to form two parts 10 and 11 in a manner such that the slope of the part 10 from the location 9 to the lower end of the element is greater than the slope of the second part 11. The upperr side of each element comprises a perforated plate 12.

As illustrated in FIG. 4, a mixture A of fragments of different material and sizes is charged to a region above the centre of the part 10 of the shaking elements. Owing to the fact that the crank shafts 2 rotate clockwise at a given frequency, there is obtained, in a manner corresponding to the apparatus illustrated in FIGS. 1–3, a division of the mixture A into three fractions B, C and D, with corresponding respective compositions as with said embodiment.

When the mixture A comprises fragmented domestic waste, the optimum amplitude for movement of the shaking elements is approximately 40–90 mm; preferably there is applied an amplitude in the region of 45–80 mm. At low amplitudes, it may be necessary to provide the shaking elements with dogging devices in order to obtain an acceptable separation result. Corresponding to each amplitude is an optimum number of revolutions for movement of the shaking elements. The separation efficiency deteriates relatively quickly on both sides of this optimum speed of revolution, and hence the useful range with regard to speed revolution is generally as narrow as 20–30 rpm. The useful rpm range can be best established by varying the speed of rotation whilst visually studying the separation with a low flow of material. The optimum speed of rotation can also be adjusted to a satisfactory degree of accuracy in this way.

The angle at which the parts 10 and 11 slope also influences the separation result. A small angle of slope of the part 11 (less than approximately 11° to the horizontal plane) will provide a large second fraction at the upper end of the shaking table, a large part of said fraction containing undesirable material. With respect to the purity of the fractions, the best results have been obtained when the angle at which the part 10 is inclined to the horizontal is between 19° and 23° and the part 11 between 14°–17°. Preferably, the angles of inclination are 20°–22° and 15°–16° respectively. A division into fractions enriched with respect to certain materials is obtained, however, at angles of inclination which lie far beyond these ranges. Large angles of inclination give a better result when using dogging devices.

The method according to the invention is not restricted to the illustrated apparatuses, but can be applied with many different types of apparatus without parting from the basic concept of the invention. Thus, the number of shaking elements used may vary from a single element to as many elements as space and practicality will permit. The construction which incorporates ridges 4 in the embodiments shown in FIGS. 1–3 is primarily conditioned by reasons of space, in order to reduce the height of the apparatus. Further, the design of the friction means can be varied to a very large extent. The mesh size of the net and the size of the perforation in the perforated plate on the upper side of the elements can be varied, not only between different apparatus but also in the longitudinal direction of one and the same shaking element, as previously mentioned. Suitable mesh sizes or sizes of the perforation lie within the range of 5–30 mm. The net or perforated plate may also be replaced by, for example, an imperforate plate when no third fraction is required. It is important that the material on the upper side of the shaking elements will provide for a high degree of bounce of those fragments which are to be separated in the first fraction.

What I claim is:

1. A method of dividing a mixture of light and heavy pieces or fragments of different materials and different sizes into two or more fractions, comprising charging the mixture from above onto a region of an inclined shaking table located below the center of the table, the table being driven from two longitudinally spaced rotary shafts to perform cyclical movements longitudinally of the table surface and up and down vertically relative to the said surface, the table having at least one inclined surface which is inclined downwards towards the lower end of the shaking table at an angle which is more steeply inclined than an imaginary line connecting the axes of the two rotary shafts, so that rebounding heavy fragments and pieces bounce down to the lower end of the table as one fraction, and friction elements mounted on the shaking table which aid in moving the other fraction to the upper end of the table, the speed of rotation of the shafts and their amplitude being so adjusted as to provide the desired bouncing movement.

2. A method according to claim 1, in which a third fraction comprising pieces and fragments of small particle size is separated through said inclined surface of the shaking table by providing a large number of openings therein whose opening sizes correspond to the largest particle size desired in said fraction.

3. A method according to claim 2 in which the shaking table is provided with two or more regions of inclined surfaces, the size of the openings of the different regions increasing in a direction towards the upper end of the shaking table, whereby further fractions can be separated.

4. A method according to claim 1 in which the shaking table is angled lengthways above the charging point for the mixture and is provided with a lower part that forms the inclined surface and is inclined at an angle which is larger than that at which an upper part is inclined, the lower part being inclined downwards towards the lower end of the shaking table.

5. A method according to claim 4 in which the angle at which the lower part is inclined to the horizontal plane is 19°–23°, and the angle at which the upper part is inclined is 14°–17°.

6. A method according to any one of claims 1–3 in which the table has a plurality of said inclined surfaces and the friction elements are fitted thereto.

7. A method according to any one of claims 1–3 in which the shaking table consists of several mutually parallel shaking elements which are connected in reverse order to the two shafts by their cranks, in such manner that their surfaces move in out-of-phase relationship.

8. A method according to any one of claims 1–3 in which the shaking table is shaken at an amplitude of 40–90 mm.

* * * * *